US005115929A

United States Patent [19]

Buono

[11] Patent Number: 5,115,929

[45] Date of Patent: May 26, 1992

[54] CHILD-RESISTANT CLOSURE WITH VISUAL CLOSE/OPEN INDICATOR

[76] Inventor: Caetano Buono, 75 Lexa Pl., Staten Island, N.Y. 10312

[21] Appl. No.: 747,378

[22] Filed: Aug. 20, 1991

[51] Int. Cl.[5] ..... B68D 55/02

[52] U.S. Cl. ..... 215/220; 215/230; 215/219; 215/216

[58] Field of Search ..... 215/219, 220, 216, 230; 116/305

[56] References Cited

U.S. PATENT DOCUMENTS

| | | | |
|---|---|---|---|
| 3,888,375 | 6/1975 | Gerk | 215/219 |
| 4,220,247 | 9/1980 | Kramer | 215/220 X |
| 4,365,722 | 12/1982 | Kramer | 215/220 |
| 4,410,098 | 10/1983 | Dubs et al. | 215/220 |
| 4,705,181 | 11/1987 | Burke et al. | 215/220 |
| 4,872,570 | 10/1989 | Harding | 215/230 |

*Primary Examiner*—Gary E. Elkins

*Assistant Examiner*—Paul A. Schwarz

[57] ABSTRACT

A child-resistant screw-on closure is provided with the closure having a closure state indicating pattern and formed as a three-element closure. The outer cap is arranged for rotation relative to the centrally located middle cap and cooperates in a torquing manner with the middle cap so that, as the closure is rotated to close the container, an indication of full sealing is viewable through a window of the outer cap only when such sealing is complete. Similarly, during rotative unsealing or opening of the container, the outer cap is the first to move relative to the remainder of the closure so that the indication of complete sealing of the container is no longer viewable through the window just as soon as rotative opening of the container has begun. Thus, the closure provides the user with a readily apparent indication as to whether the container closure is in its fully closed or container-sealing condition.

8 Claims, 3 Drawing Sheets

CHILD-RESISTANT CLOSURE WITH VISUAL CLOSE/OPEN INDICATOR

FIELD OF INVENTION

This invention relates generally to a child-resistant screw-on closure for use on a container with the child-resistant screw-on closure including relatively rotatable components for indicating whether or not the closure is in a fully sealed condition.

BACKGROUND OF THE INVENTION

The present invention relates generally to a child-resistant closure device having a closure state indicating pattern. This allows the user to visually determine whether the cap is in a safe "child-proof" position or an unsafe position in which it may be removed from the threaded container by simple rotation.

More specifically, the subject invention is formed as a three-element child-resistant container closure, with the three elements coaxial and nested one within the other. The outermost element is arranged for rotation relative to the centrally-located or middle element. The outermost element is provided with a window which is registrable with indicia provided on the central element. The outermost and central elements cooperate in a torquing manner so that, as the closure is rotated to close the container, an indication of full sealing is viewable through the window of the outermost cap only when such sealing is complete. Similarly, during rotative unsealing or opening of the container, the outermost member first moves relative to the remainder of the closure so that the window moves out of register with the full sealing indicium and into register with an unclosed indicium to give an indication viewable through the window just as soon as rotative opening of the container has begun that the closure no longer seals. Thus, the closure provides the user with a readily apparent indication as to whether or not the container closure is in its fully closed or container-sealing condition.

Child-resistant closure devices for containers having a threaded neck are known and are described. However, prior art attempts have suffered from various drawbacks as discussed below.

For example, U.S. Pat. No. 3,216,600 to Dreps discloses a container and closure cap combination having a screw thread formation which insures proper registry of the surface decoration applied to the container and the closure cap. Thus, a directional closure cap and container combination is disclosed wherein both accurate registration of decorative matter on the closure cap and container and reliable sealing are obtained. This reference, however, does not teach the use of a closure state indicating pattern viewable through a window of the outer cap.

U.S. Pat. No. 4,271,971 to Morris discloses a three component safety cap for use on threaded containers which is rotationally operated so that the cap is either in a safe or "child proof" mode or an unsafe mode in that it may be removed from the threaded container by simple rotation. Optionally, the safety cap may include a visual indicator of its safe or unsafe condition. However, there is no indication in the reference of an outer cap having means for frictional engagement in order to provide an increasing interference fit between the middle and outer caps when the outer cap is rotated in a closed direction, as taught herein.

U.S. Pat. No. 4,500,005 to Forrester discloses a tamper-evident cap assembly for a container having an externally screw-threaded top which ratchets from position to position. The outer cap has a window with the inner cap having an insignia which is not visible in the window when the outer cap is in its initial relatively clockwise position relative to the inner cap. This visual indicator operates as to whether the package has ever been opened. This reference, however, does not teach a child-resistant cap nor a three element cap in which the outer cap has means for frictional engagement with a radially differing groove portion of a middle cap which provides for an increasing interference fit between the middle and outer caps so that an indicating pattern of full sealing is viewable through a window on the outer cap, as taught herein.

U.S. Pat. No. 4,826,000 to Danker et al. discloses a container for storing contact lenses and conditioning them with a liquid that releases gas, with the container having a visual indicator in order to determine a desired container tightness. There is no indication in the reference of an indicating pattern of full sealing that is torqued in and out of position.

None of the prior art, however, teaches or suggests a child-resistant closure having indicating means formed of an inner cap, a middle cap and an outer cap and a means for frictional engagement with a radially differing groove portion of the middle cap in order to provide an increasing interference fit between the middle and the outer caps as the outer cap is rotated in one direction. Moreover, no other prior art reference discloses an outer cap which first frictionally engages a middle cap in a torquing manner causing the middle cap to remain stationary relative to the outer cap, with complimentary knurlings on the middle and inner caps also causing the inner cap to remain stationary relative to the outer cap so that as force is applied to rotate the outer cap to close the container, the threaded portion of the inner cap seals the threaded portion of the container.

It is, therefore, an object of the invention to provide a child-resistant closure which is rotatable for indicating whether the closure is in its fully sealing condition.

Another object of the invention is to provide a simple child-resistant closure with means for indicating whether the cap is in a fully closed condition.

A further object of the invention is to provide a child-resistant closure with indicating means which can be readily installed on a bottle during a manufacturing process.

Still other objects and advantages of the invention will in part be obvious and will in part be apparent from the specification.

SUMMARY OF THE INVENTION

Generally speaking, in accordance with the invention a child-resistant closure for indicating whether the closure in its fully sealing condition on a container is provided. The child-resistant closure includes coaxial nesting inner, middle and outer caps. The inner cap has a circular top wall portion and a cylindrical skirt depending from the top wall portion. The inner surface of the skirt is threaded for threaded engagement with the container when the inner cap is rotated in a closing direction and disengageable therefrom when the inner cap is rotated in an opening direction. The inner cap also has a plurality of angularly extending knurlings located on the outer surface of the skirt.

The middle cap is provided which has a circular top wall portion and a cylindrical skirt coaxial with and peripherally surrounding the cylindrical skirt portion of the inner cap. The middle cap is axially displaceable relative to the inner cap. The inner portion of the skirt of the middle cap has a plurality of angularly extending knurlings complementary to and angled the same way as the plurality of angularly extending knurlings located on the outer skirt surface of the inner cap. This is provided so that when the middle cap is rotated in the opening direction, the complementary middle cap knurlings ride up the inner cap knurlings to prevent transmission of the rotational force from the middle cap to the inner cap unless an axial force is applied to the middle cap to prevent such camming action in which case the inner and middle caps rotate together.

The middle cap also has a grooved slot which has a first end and a second end along the circumference of the outer skirt. The radial distance from the first end of the grooved slot to the center of the middle cap is greater in the closing direction than the radial distance from the second end of the grooved slot to the center of the middle cap in the opening direction. The middle cap is also provided with a raised stopper located at and defining the first end of the grooved slot.

The child-resistant closure has an outer cap arranged for rotation relative to the middle and inner caps. The outer cap has a circular top, a cylindrical skirt coaxial with and peripherally surrounding the skirt of the middle cap and means for frictional engagement with the radially differing grooved portion of the middle cap. Thus, the means for frictional engagement provides an increasing interference fit between the middle and outer caps as the outer cap is rotated in one direction so that the outer cap first frictionally engages the middle cap in a torquing manner causing the middle cap to retain stationary relative to the outer cap. The complimentary knurlings on the middle and inner caps cam the middle and inner caps into engagement to cause the inner cap to remain stationary relative to the outer cap during closing. Thus, as force is applied to rotate the outer cap to close the container, the threaded portion of the inner cap seals the threaded portion of the container. Thereafter, the outer cap moves relative to the middle and inner caps and causing the means for frictional engagement to ride on the radially differing grooved portion of the middle cap increasing the frictional engagement. Accordingly, an indicating pattern of full sealing, located on the middle cap is viewable through a window on the outer cap.

Conversely, when the outer cap is rotated in an opposite direction with the use of both rotational and axial force to open the container, the outer cap first moves relative to the middle cap allowing an indicating pattern of partial or non-sealing located on the middle cap to be viewable through the window on the outer cap. Secondly, the means for frictional engagement abuts the raised stopper so that the closure may be disengaged from the container.

The invention accordingly describes the features of construction, combination of elements, and arrangements of parts which will be exemplified in the constructions hereinafter set forth and the scope of the invention will be indicated in the claims.

DETAILED DESCRIPTION OF THE DRAWINGS

For a fuller understanding of the invention, reference is had to the following description taken in connection with the accompanying drawings in which.

For convenience of reference, like components, structural elements and features in the various figures are designated by the same reference numerals or characters.

DESCRIPTION OF THE PREFERRED EMBODIMENTS

The child-resistant closure provided in accordance with the invention, includes inner, middle and outer caps with the outer cap arranged for rotation relative to the middle and inner caps. The outer cap has a circular top, a cylindrical skirt coaxial with and peripherally surrounding the skirt of the middle cap and means for frictional engagement with the middle cap. Specifically, the means for frictional engagement with the radially differing grooved portion of the middle cap provides an increasing interference fit between the middle and outer caps as the outer cap is rotated in a closing direction so that the outer cap first frictionally engages the middle cap in a torquing manner causing the middle cap to remain stationary relative to the outer cap.

Figure 1:
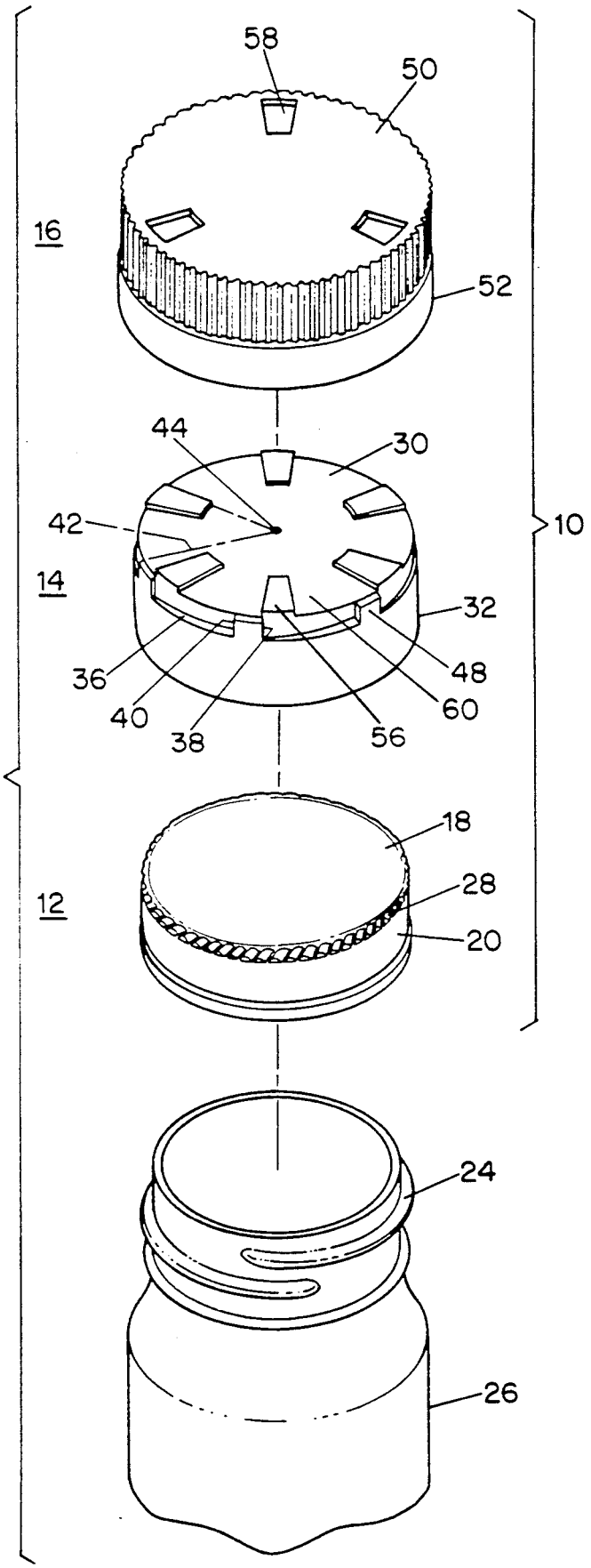
FIG. 1 is an exploded perspective view of a child-resistant closure which is rotatable for indicating whether the closure is in its fully closed state and bottle constructed and arranged in accordance with the invention.
Figure 4:
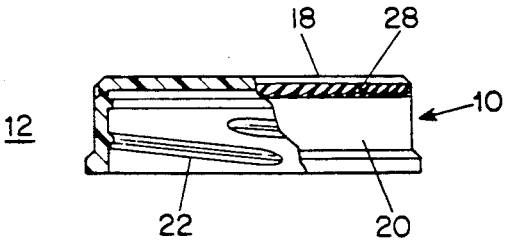
FIG. 4 is a partial cross-sectional side view of the inner cap of the child-resistant closure of FIG. 1.

Referring specifically to FIG. 1 of the drawings, a child-resistant closure 10 is constructed and arranged in accordance with the invention. Closure 10 includes an inner cap 12, a middle cap 14 and an outer cap 16 which are in axial alignment and in nested relation with one another. The inner cap 12 has a circular top wall portion 18 and a cylindrical skirt 20 depending from the top wall portion 18. The inner surface of the skirt 22, as shown in FIG. 4, is threaded for threaded engagement with a threaded portion 24 of a container 26 when the inner cap 12 is rotated in a closing direction, here shown by way of example to be clockwise. The inner cap 12 is disengageable from the threaded portion 24 of the container 26 when rotated in an opening direction, here, e.g. counterclockwise. The inner cap also has a plurality of angularly extending knurlings 28 located on the outer surface of the skirt 20 which angle extends downwardly and in the closing direction.

Figure 3:
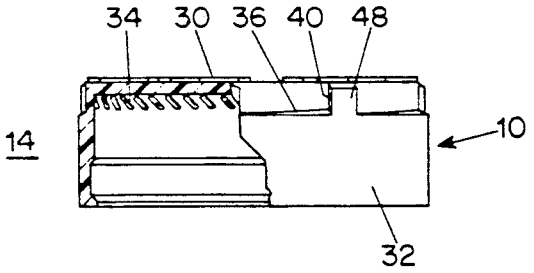
FIG. 3 is a partial cross-sectional side view of the middle cap of the child-resistant closure of FIG. 1.

The middle cap 14 has a circular top wall portion 30 and a cylindrical skirt 32 coaxial with and peripherally surrounding the cylindrical skirt portion 20 of the inner cap 12. As shown in FIG. 3, the inner portion of the skirt 32 of the middle cap 14 has a plurality of angularly extending knurlings 34 complementary to and angled the same way as the plurality of angularly extended knurlings 28 located on the outer skirt 20 of the inner cap 12. Thus, when the middle cap 14 is rotated in an opening direction the complementary middle cap knurlings 34 tend to ride up the inner cap knurlings 28 to prevent transmission of the opposite direction rotation from the middle cap 14 to the inner cap 12, the middle cap 14 being axially displaceable relative to the inner cap 12, in order to prevent the disengagement of the inner cap 12 from the container 26. This can only be overcome by the simultaneous application of a turning force and an axial force, the latter of which prevents the knurlings on the middle cap from riding up the knurlings on the inner cap.

The middle cap 14 is provided on the skirt 32 with one or more cam surfaces 36, here shown as six in number, which angle outwardly from the center of middle cap 14 as the cam surface extends from in the direction of closing. Between each cam surface 36 there is located a stopper 48. Thus the front end of the cam surface in the closing direction, designated by the reference numeral 38, is further from the center of middle cap 14 than in the trailing edge of the cam surface 38, designated by the reference numeral 40.

Figure 2:
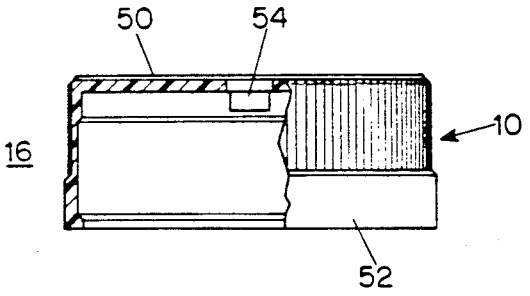
FIG. 2 is a partial cross-sectional side view of the outer cap of the child-resistant closure of FIG. 1.
Figure 7:
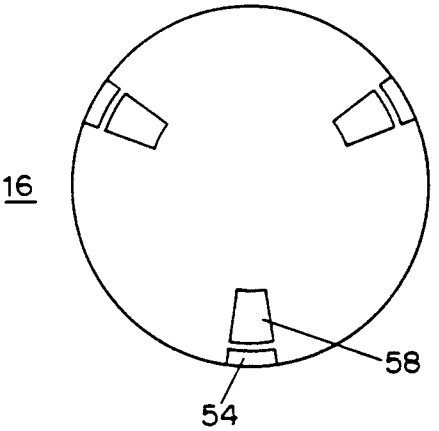
FIG. 7 is a bottom view of the outer cap as shown in FIGS. 2 and 5.

The outer cap 16 is arranged for rotation relative to the middle and inner caps 12, 14 and has a circular top 50, a cylindrical skirt 52 coaxial with and peripherally surrounding the skirt of the middle cap 32 and means 54 for frictionally engaging cam surface 38 as shown in FIGS. 2 and 7. The means for frictional engagement with the radially differing grooved portion 38 of the middle cap 14 provides an increasing interference fit between the middle and outer caps 14, 16, as the outer cap 16 is rotated in a closed direction so that the outer cap 16 first frictionally engages the middle cap 14 in a torquing manner causing the middle cap 14 to remain stationary relative to the outer cap 16. The complimentary knurlings 28, 34 on the middle and inner caps 14, 12 also cause the inner cap 12 to remain stationary relative to the outer cap 16 so that as force is applied to rotate the outer cap 16, to close the container 26, the threaded portion 22 of the inner cap 12 seals the threaded portion 24 of the container 26. Thereafter, the outer cap 16 moves relative to the middle and inner caps 12, 14 causing the means for frictional engagement 54 to ride on the radially differing grooved portion 36 of the middle cap 14 increasing the frictional engagement so that an indicating pattern 56 of full sealing, is viewable through a window 58 on the outer cap 16.

In order to use the child-resistant closure provided in accordance with the invention, the user first places the closure 10 on the container 26 and uses a rotative force to turn the outer cap 16 in the closing direction. At this point, a red warning color is visible through the window 58 on the outer cap 16. The means for frictional engagement 54, interferes with the cam surface 36 and causes the outer cap 16 to remain stationary relative to the middle cap 14. The complimentary knurlings 28, 34 on the middle and inner caps 14, 12 also cause the inner cap 12 to remain stationary relative to the outer cap 16. Thus, as the user closes the container, the rotative force provides a seal between the threaded portion 24 of the container 26 and the threaded portion 22 of inner cap 12. Once the container 26 is full sealed and the inner cap can be turned no more, the user continues to apply a rotative force, so that the interference fit provided by the means for frictional engagement 54 is increased when the means for frictional engagement 54 rides on the cam surface 36 toward the front end 38 of the cam surface 36, which, is farther from the center 44 of the middle cap 14 than the trailing edge 40 of the cam surface 36. Thus, the outer cap 16 moves relative to the middle and inner caps 14, 12. The middle cap 14 remains stationary relative to the inner cap 12 due to the fact that it is fixed relative to the now stationary inner cap by the complimentary interengaged knurlings 28, 34. Thus, an indicating pattern 56 of full sealing, preferably a green color, is now viewable through the window 58 of the outer cap 16.

In order to open the sealed container 26, the user must utilize both a rotative and an axial force, the latter of which prevents the knurlings 34 on the middle cap 14 from riding up the knurlings 28 on the inner cap 12. Thus, when the outer cap 16 is rotated in an open direction, with the use of both rotational and axial force, the outer cap 16 first moves relative to the middle and inner caps 14, 12 allowing the red indicating pattern 60 of partial or non-sealing located on the middle cap 14 to be viewable through the window 58 on the outer cap 16. The complimentary knurlings 34 on the middle caps 14 which have a tendency to ride up the inner cap 12, are overcome by the axial force. Thus, the outer cap is first to move relative to the middle and outer caps because the means for frictional engagement 54 is overcome when the means for frictional engagement 54 rides on the cam surface 36 toward the trailing edge 40 which is closer to the center 44 of the middle cap 14 than the front end 38 of the cam surface 36. As the opening continues, the means for frictional engagement 54 abuts the raised stopper 40 and the axial force prevents the knurlings 34 in the middle cap 14 from riding up the knurlings 28 on the inner cap 12 so that all three caps move in unison. This allows the threaded portion 22 of the inner cap 12 to be disengaged from the threaded portion 24 of the container 26. Accordingly, the closure 10 is disengaged from the container 26.

As shown in FIG. 2, the means for frictional engagement 54 with the radially differing grooved comprises one or more elements projecting radially inward from the outer cap 16 with the radial projecting element 54 being sized and configured to increasingly interfere with the radially differing grooved when the outer cap 16 is rotated to close the container 26. As shown by way of example only, three such projecting elements spaced uniformly about the skirt 52 of the outer cap 16 are employed.

Figure 5:
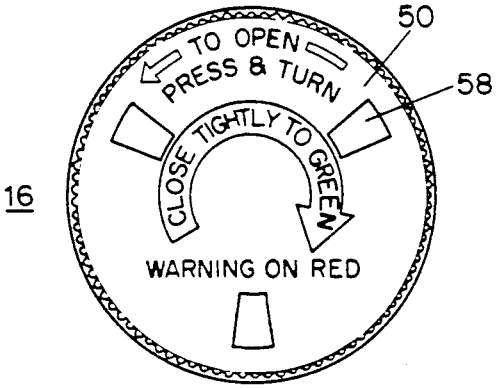
FIG. 5 is a top plan view of the outer cap of the child-resistant closure of FIG. 2.
Figure 6:
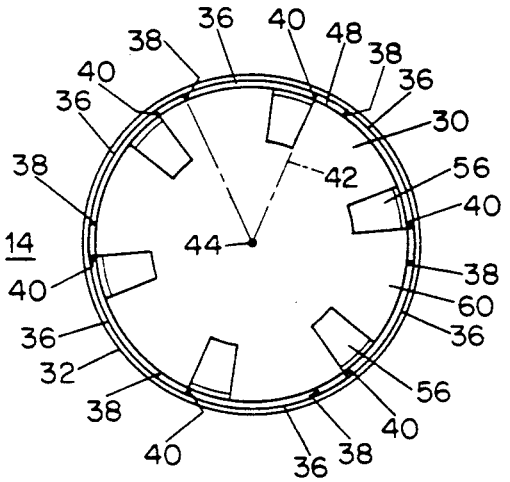
FIG. 6 is a top plan view of the middle cap of the child-resistant closure of FIG. 3.

FIG. 5 shows the top surface 50 of the outer cap. To open the child-resistant screw-on closure 10, the user applies both an axial and a rotative force in order to prevent disengagement of the inner and middle caps and turn the entire closure 10 in a anticlockwise or opening direction. To close the child-resistant closure 10, the user turns the closure 10 in an clockwise direction. Once in a clockwise direction, indicating pattern 56, preferably green, which is located on the middle cap 14, is displayed through the window 58 of the outer cap 16 to indicate complete sealing or closure. When the closure 10 is not properly sealed, the indicating pattern 60, as shown in FIG. 6 which is preferably red, is displayed through the window 58 of the outer cap 16.

Figure 8:
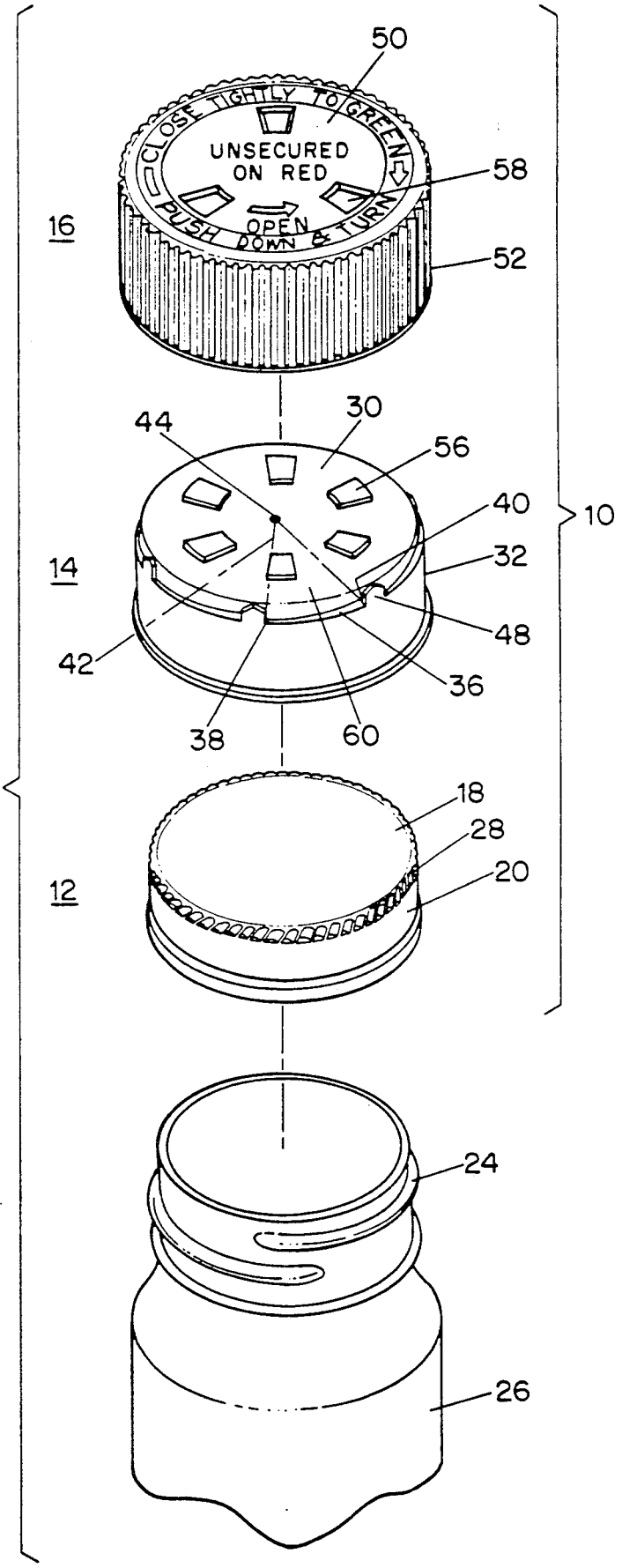
FIG. 8 is an exploded perspective view of a child-resistant closure which is rotatable for vindicating whether the closure is in its fully closed state and bottle constructed and arranged in accordance with the invention.

FIG. 8 shows an alternate embodiment of the invention where both the top of the stopper 48 and the means for frictional engagement 54 are pointedly angled in a roof-like manner in order to facilitate assembly. Thus, when the outer cap 16 is placed on the middle cap 14, and if the means for frictional engagement 54 and the stopper 48 come into contact, the angles of the stopper 48 insure that the means for frictional engagement 54 will slide either to the left or right of the stopper 48. This insures that the means for frictional engagement 54 always rides in one of the cams 36 of the middle cap 14.

It will also be understood that while the one-way torque transmitting means made up of angle knurlings 28 and 34 is preferred other one-way transmitting means may be employed herein without departing from the present invention.

It is to be understood that the child-resistant closure device with indicating means provided in accordance with the invention can be formed of any suitable material such as plastic or metal or a combination of materials and the like and that the invention is not intended to be limited by the material from which the devices are formed.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A child-resistant screw-on closure for use on a container having a threaded portion threadedly engageable with the screw-on closure, the closure having a closure-state indicating pattern, comprising:

an inner cap having a circular top wall portion and a cylindrical skirt depending from the top wall portion, the inner surface of the skirt being threaded for threaded engagement with the container when the inner cap is rotated in a closing direction and disengageable therefrom when the inner cap is rotated in an opening direction;

a middle cap having a circular top wall portion and a cylindrical skirt coaxial with and peripherally surrounding the cylindrical skirt portion of the inner cap, said middle cap being axially displaceable relative to said inner cap, a cam surface having a front end and a trailing end along the circumference of the outer skirt of said middle cap as said middle cap is rotated in the closing direction with the front end being at a greater radial distance from the center than the trailing end, an indicating pattern and a raised stopped on said cylindrical skirt of said middle cap and an outer cap arranged for rotation relative to the middle and inner caps and having a circular top, a cylindrical skirt coaxial with and peripherally surrounding the skirt of the middle cap, a window, means for frictional engagement with said camming surface of said middle cap providing a progressively increasing frictional engagement between said middle and outer caps as said outer cap is rotated in said closing direction so that the outer cap first rotates relative to said middle cap until said frictional engagement means frictionally engages the camming surface of the middle cap to transmit torque thereto, thereby causing the middle cap to rotate together with the outer cap; and one-way torque transmitting means connecting said middle cap to said inner cap to cause them to rotate together in the closing direction and to prevent concurrent rotation of said inner and middle caps in the opening direction in the absence of the application of axial force thereto, whereby rotation in the closing direction of the outer cap will cause like rotation of said middle and inner caps so that, the threaded portion of the inner cap seals the threaded portion of the container, and thereafter, the outer cap moves relative to the middle and inner caps causing said means for frictional engagement to ride on said cam surface of the middle cap increasing said frictional engagement so that said indicating pattern on the middle cap is viewable through said window on the outer cap and, conversely, when the outer cap is rotated in said opening direction with the use of both rotational and axial force to open the container, the outer cap first moves relative to the inner cap allowing said indicating pattern on the middle cap to be viewable through the window on the outer cap and secondly abuts said raised stopper wherein the closure is disengaged from said container.

2. The child-resistant closure of claim 1, wherein said one-way torque transmitting means comprises a plurality of angularly extending knurlings located on the inner portion of said cylindrical skirt of said middle cap and a plurality of angularly extended knurlings located on the outer skirt of the inner cap complimentary to and angled the same way as the plurality of angularly extended knurlings located on the inner portion of the cylindrical skirt of the middle cap so that when the middle cap is rotated in said opening direction, the complementary middle cap knurlings ride up the inner cap knurlings to prevent transmission of said opening direction rotation from the middle cap to the inner cap.

3. The child-resistant closure of claim 1, wherein said indicating pattern comprises an indicating pattern of partial sealing and an indicating pattern of full sealing both patterns which are viewable through said window located on said circular top of said outer cap.

4. The child-resistant closure of claim 1, wherein said indicating pattern comprises an indicating pattern of partial sealing and an indicating pattern of full sealing both patterns which are viewable through said window located on the skirt of said outer cap.

5. The child-resistant closure of claim 1, wherein the outer cap has a plurality of windows in order to view the indicating pattern.

6. The child-resistant closure of claim 1, wherein the outer, middle and inner caps are made of a plastic material.

7. The child-resistant closure of claim 1, wherein the pattern of indicating full sealing is a green color.

8. The child-resistant closure of claim 1, wherein the pattern of indicating partial sealing is a red color.

* * * * *

UNITED STATES PATENT AND TRADEMARK OFFICE

CERTIFICATE OF CORRECTION

PATENT NO. : 5,115,929

DATED : May 26, 1992

INVENTOR(S) : Caetano Buono

It is certified that error appears in the above-identified patent and that said Letters Patent is hereby corrected as shown below:

On the title page add the assignee field --
[73] Assignee: Van Blarcom Closures, Inc.
156 Sanford Street
Brooklyn, New York 11205--.

Signed and Sealed this

Second Day of November, 1993

*Attest:*

Bruce Lehman

BRUCE LEHMAN

*Attesting Officer*

*Commissioner of Patents and Trademarks*